US006213825B1

(12) United States Patent
Ozawa

(10) Patent No.: US 6,213,825 B1
(45) **Date of Patent: *Apr. 10, 2001**

(54) FUEL INJECTION SYSTEM FOR SMALL WATERCRAFT

(75) Inventor: Shigeyuki Ozawa, Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/199,735

(22) Filed: Nov. 25, 1998

(30) Foreign Application Priority Data

Nov. 26, 1997 (JP) ..... 9-342258
Feb. 28, 1998 (JP) ..... 10-064689

(51) Int. Cl.[7] ..... B63H 21/10
(52) U.S. Cl. ..... 440/88

(58) Field of Search ..... 123/73 C, 305; 114/55.5; 440/88

(56) References Cited

U.S. PATENT DOCUMENTS 3,236,218 * 2/1966 Ziegler ..... 123/73 C
5,762,040 * 6/1998 Taipale et al. ..... 123/73 C
6,022,253 * 2/2000 Ozawa et al. ..... 440/89

* cited by examiner

*Primary Examiner*—Ed Swinehart
(74) *Attorney, Agent, or Firm*—Ernest A. Beutler

(57) ABSTRACT

A number of embodiments of personal watercraft incorporating direct cylinder injected two cycle crankcase compression engines. In all embodiments, the fuel injector is positioned so that it will be protected by either or both of the exhaust and intake systems of the engine from damage and also from water vapor while still affording ease of accessibility therefore. A variety of injector and associated spark plug locations are depicted.

19 Claims, 8 Drawing Sheets

FUEL INJECTION SYSTEM FOR SMALL WATERCRAFT

BACKGROUND OF THE INVENTION

This invention relates to a small watercraft and more particularly to an improved fuel injection arrangement for such watercraft.

It is well known that two cycle engines have wide applicability for a number of uses where small size, simple construction and high specific output are desired. A typical example of such applications is as the power plant for a type of water vehicle referred to generally as a "personal watercraft."

Personal watercraft are watercraft that are relatively sporting in nature and that are designed primarily to be operated by a single operator who may carry only a few passengers with him. Frequently, the operator and passenger are seated in straddle fashion and when a plurality of passengers are carried, they sit in tandem. These types of watercraft are quite compact and thus, require compact propulsion systems including the engine.

However, because of environmental concerns and some difficulties in obtaining good exhaust emission control, power sources other than two cycle engines are being considered. However, if the efficiency of a two-cycle engine can be improved by an expedient such as fuel injection, and particularly direct fuel injection, then the replacement with four cycle engines may not be necessary.

Because of the compact nature of these watercraft and particularly their engine compartment and the access thereto, the provision of fuel injection systems presents some problems. This is particularly true with direct fuel injection systems wherein the fuel injector injects directly into the combustion chamber of the engine. Such arrangements position the fuel injector generally in the area of the cylinder head and thus, place it in an area where it may be exposed to damage or water which could deteriorate its performance, particularly if it is electrically operated.

On the other hand, it is desirable if the engine is mounted so that the injector can be easily accessed for service, but this places it is in a position where it may be inadvertently struck or where water may be able to contact it.

It is, therefore, a principal object of this invention to provide a direct cylinder fuel injection engine for use in personal watercraft.

It is a further object of this invention to provide a personal watercraft having a direct cylinder injection system where the injector is readily accessible for servicing but is protected by other components of the engine from damage and water.

SUMMARY OF THE INVENTION

This invention is adapted to be embodied in a personal watercraft that is comprised of a hull that defines a rider's area for accommodating a rider and not more than three passengers. An engine compartment is formed in the hull. An internal combustion engine is supported within the engine compartment and drives a hull watercraft propulsion device for propelling the hull through a body of water. A fuel injector is supported in an upper part of the engine for injecting fuel directly into a combustion chamber thereof. An air induction system is provided for delivering an air charge to combustion chamber. An exhaust system is also provided for discharging a burnt charge from the combustion chamber. At least one portion of one of the induction and exhaust systems is positioned at a point that extends vertically above and in proximity to the fuel injector for protecting the fuel injector without interfering with its serviceability access.

DETAILED DESCRIPTION OF THE PREFERRED EMBODIMENTS OF THE INVENTION

Figure 1:
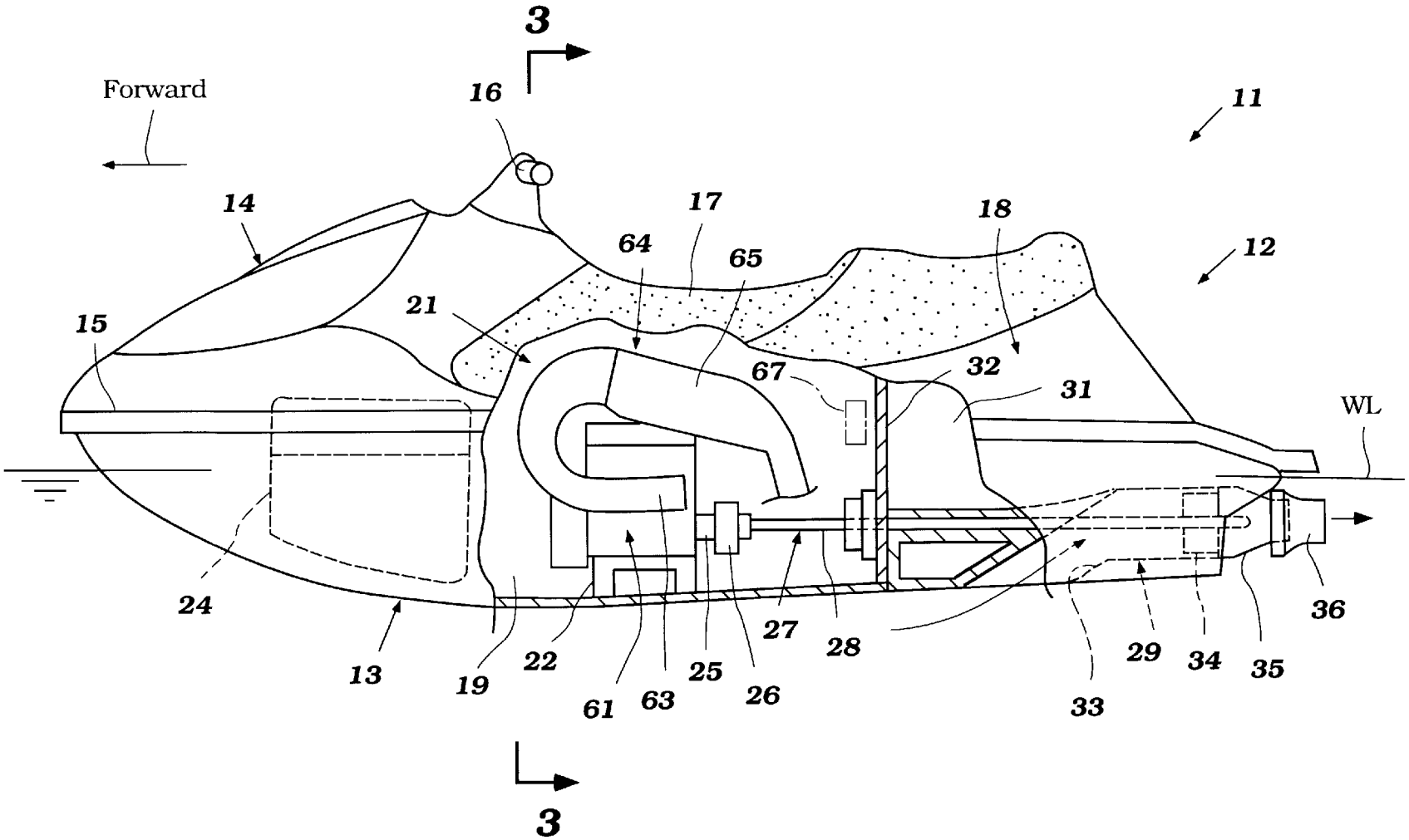
FIG. 1 is a side elevational view of a personal watercraft, with a portion broken away, and showing a first embodiment of the invention.
Figure 2:
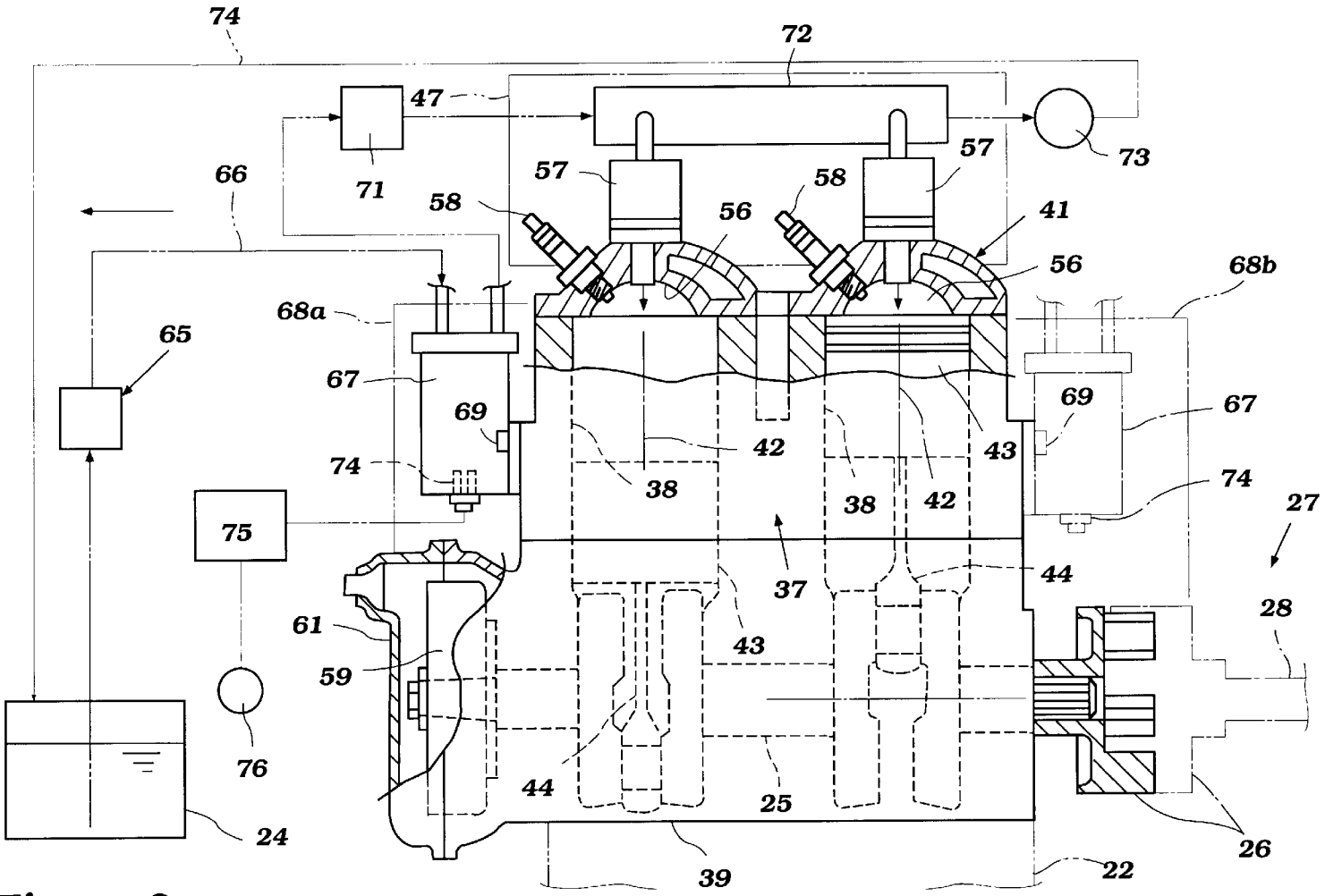
FIG. 2 is an enlarged side elevational view of the watercraft engine, with portions broken away and shown in section, and with certain of the auxiliaries shown schematically.
Figure 3:
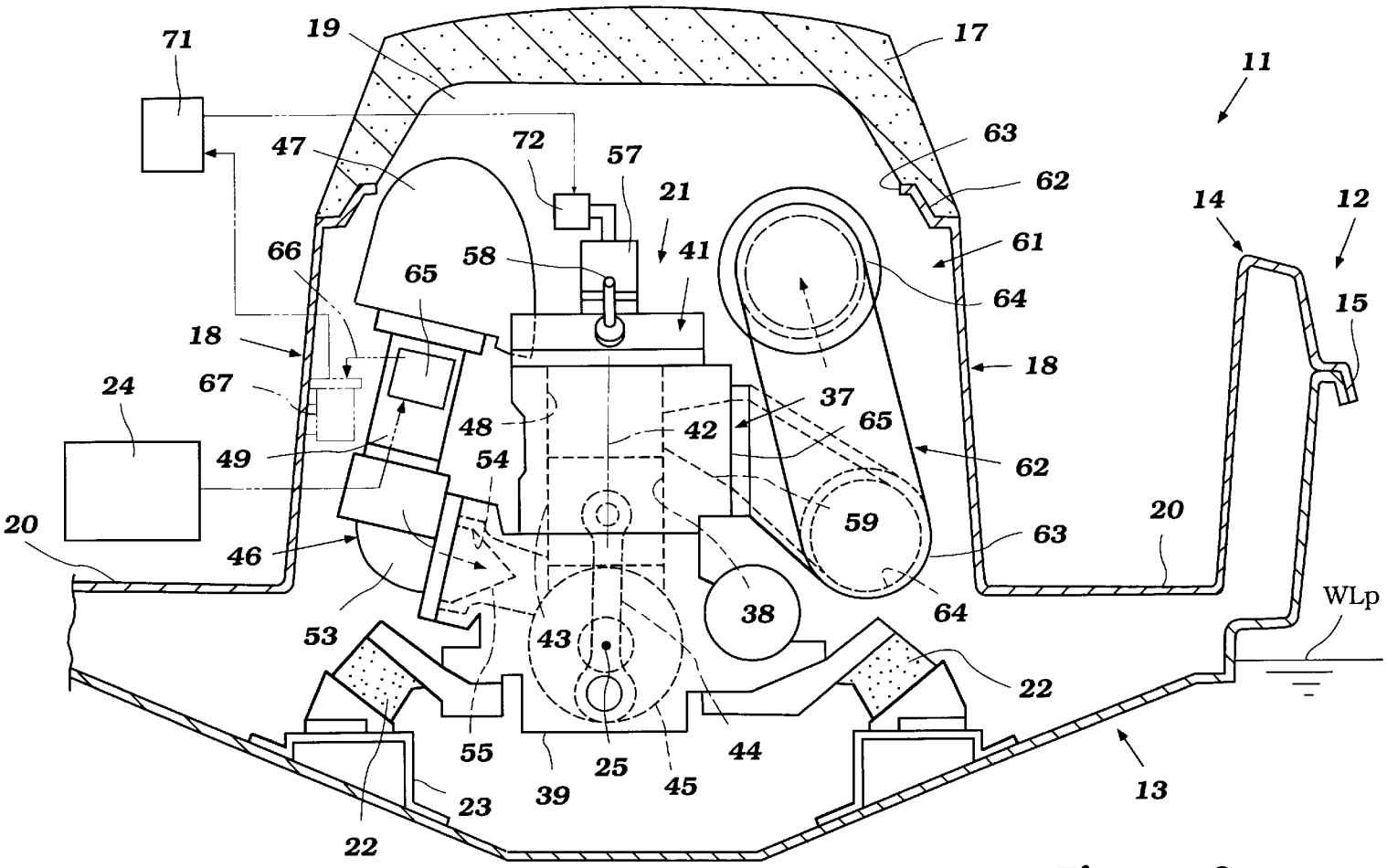
FIG. 3 is a cross-sectional view of the watercraft taken along the line 3—3 of FIG. 1.

Referring now in detail to the drawings and first to the embodiment of FIGS. 1–3, a personal watercraft constructed in accordance with this embodiment of the invention is identified generally by the reference numeral 11. The personal watercraft 11 is comprised of a hull assembly 12 that is comprised primarily of a lower hull part 13 and an upper, main hull or deck part 14. These hull parts 13 and deck part 14 may be formed from a suitable material such as a molded fiberglass reinforced resin or the like. These parts are secured together around their outer periphery to form a gunnel 15 in a suitable manner.

A control mast 16 is provided at the forward part of the deck 14 in front of a seat assembly, indicated generally at 17. This seat assembly 17 is mounted on a raised portion 18 of the deck and defines in major part the rider's area for the watercraft. A pair of depressed foot areas 20 are disposed on opposite sides of the seat 17 so that the rider may place his feet in these foot areas seated in straddled fashion on the seat 17. The rider operator is disposed immediately behind the mast 16. He may carry up to the three passengers behind him on the seat, seated in tandem fashion.

The inner portion of the hull assembly 12 defines an engine compartment 19 which is formed in major part beneath the seat 17. An internal combustion engine 21 is mounted in this engine compartment in a suitable manner. This mounting may include a pair of elastic isolators 22 (FIG. 3) that are mounted on pedestals 23 of the hull inner part. The internal construction of the engine 21 will be described in more detail shortly.

A hatch area is provided at the forward portion of the deck 14 and may contain a storage compartment having a removable lower wall. A fuel tank 24 that contains fuel for the engine 21 is disposed in this area. Fuel is supplied from the fuel tank 24 to the engine 21 in a manner which will also be described.

The engine 21 is mounted in the engine compartment 19 so that its crankshaft 25 rotates about a generally longitudinally extending axis. This crankshaft is coupled by means of a coupling 26 to a propulsion unit, indicated generally by the reference numeral 27 and specifically an impeller shaft 28 of a jet propulsion unit, indicated generally by the reference numeral 29.

The jet propulsion unit 29 is mounted in a tunnel area 31 formed in the under part of the hull portion 13 beneath the rear part of the raised seat portion 18 and rearwardly of a bulkhead 32 that provides a water barrier at the rear end of the engine compartment 19.

Although other types of propulsion systems may be employed, conveniently the jet propulsion unit 29 is comprised of an outer housing that defines a water inlet tract 33 that originates at downwardly facing water inlet opening formed in the undersurface of the hull part 13.

An impeller 34 is affixed to the impeller shaft 28 within this jet propulsion unit 29 and draws the water in through the inlet tract 33 and discharges it rearwardly through a discharge nozzle 35. A steering nozzle 36 is pivotally supported about a vertically extending axis on the discharge nozzle 35 and is pivoted by the mast 16 so as to change the direction of travel of the watercraft 11 in a manner well known in this art.

Referring now primarily to FIGS. 2 and 3, the construction of the engine 21 will be described in more detail. The engine 21 is, in the illustrated embodiment, of the two-cylinder inline type and operates on a two-stroke crankcase compression principle. Although the invention is described in conjunction with an engine having this number of cylinders, it will be readily apparent that the invention can be utilized with engines having a varying number of cylinders and having varying cylinder configurations. Certain facets to the invention may also be employed in conjunction with four-cycle engines, but for the reasons aforenoted the invention has particular utility with two-cycle engines.

The engine 21 therefore includes a cylinder block 37 in which, in this embodiment, two vertically extending cylinder bores 38 are formed. The lower ends of the cylinder bores are closed by means of a crankcase member 39 that is detachably connected to the underside of the cylinder block 37 in a suitable manner. The crankshaft 25 is suitably journalled within a crankcase chamber formed primarily by the crankcase member 39.

The opposite ends of the cylinder bores 38 are closed by a cylinder head assembly 41 that is detachably connected to the cylinder block 37 in any suitable manner.

The cylinder bores 38 define respective axes 42 that extend vertically in this embodiment and pistons 43 are supported for reciprocation in these cylinder bores 38 along the axes 42. The pistons 43 are connected by means of piston pins (not shown) to the small ends of connecting rods 44. The big ends of these connecting rods 44 are, in turn, journaled on the crankshaft 25 in any suitable manner.

As is typical with two-cycle, crankcase compression engines, the sections of the crankcase chamber associated with each cylinder bore 38 are sealed from each other. To this end, the crankshaft 25 may be formed with or cooperate with sealing members 45 which, in effect, form a part of this seal.

One side of the engine 21 may be considered to be the intake side and an induction system, indicated generally by the reference numeral 46, supplies an intake air charge to this side of these crankcase chamber sections in a manner which will be described shortly. This induction system includes an air inlet device 47 that is disposed at a relatively high position on one side of the engine, for a reason which will become apparent.

This inlet device 47 may include a suitable silencing mechanism and has a downwardly facing air inlet opening 48 that is disposed between one side of the cylinder block 37 and a throttle body 49 which receives the intake air from the intake device 47. Thus, the air that is drawn into the induction system will be shielded and the likelihood of picking up water from the bilge will be substantially precluded.

A throttle valve is positioned within the throttle body 49 and is controlled by means of a throttle control which is, in turn, operated by a remotely located throttle control. This throttle control may be mounted on the steering mast 16.

Air at a volume controlled by the position of the throttle valve in the throttle body 49 will enter into an intake manifold 53 which communicates with intake ports 54 formed in the crankcase member 39. Each intake port 54 serves a respective one of the crankcase chamber afore referred to.

A read-type check valve assembly 55 is provided in each intake port 54. This read-type check valve 55 permits air to flow into the respective crankcase chambers as the pistons 43 are moving upwardly in their respective cylinder bores. When the pistons 43 move downwardly, this charge will be compressed in the crankcase chambers and the read-type check valves 55 will close to preclude reverse flow through the induction system 46.

The charge which is compressed in the crankcase chambers will be transferred through a scavenging system (not shown) of any type known in this art to combustion chambers that are formed by the piston 43, the cylinder bores 38 and recesses 56 formed on the underside of the cylinder head assembly 41.

Fuel injectors, of any suitable type and indicated by the reference numeral 57, are mounted in the cylinder head assembly 41 in a location as will be described and spray a fuel charge directly into the combustion chamber. The timing and duration of fuel injection can be controlled by any suitable control strategy. The manner in which fuel is delivered to the fuel injector 57 from the fuel tank 54 will be described shortly.

Thus, a fuel air charge will be formed in the combustion chamber. This charge is then fired by spark plugs 58 that are mounted in the cylinder head assembly at a location which will also be described. The spark plugs are fired by a suitable ignition circuit, which can be provided with electrical power from a magneto generator 59 fixed to the forward end of the crankshaft 25 and covered by a cover 61. This is the end opposite that which the coupling 26 couples the crankshaft 25 to the impeller shaft 28.

The ignited charge will bum and expand so as to drive the pistons 43 downwardly in the cylinder bores 38 and effect rotation of the crankshaft 25.

Exhaust ports 59 are formed in the cylinder block 37 on the opposite side from the induction system 46. These exhaust ports 59 communicate with an exhaust system, indicated generally by the reference numeral 61, for discharging the exhaust gases to the atmosphere through a path which will now be described.

First, the exhaust system includes an exhaust manifold assembly, indicated generally by the reference numeral 62, which has a collector portion 63 having a collector section 64 that receives exhaust gases from the exhaust ports 59.

This exhaust manifold 62 is affixed to an exhaust side 65 of the cylinder block 37 in a suitable manner.

The exhaust gases collected by the manifold 63 are passed forwardly through an upwardly curved section, as best seen in FIG. 1, to an expansion chamber device, indicated by the reference numeral 64, and which extends on a relatively high location on the opposite side of the cylinder head from the intake device 47. As a result of this and as clearly seen in FIGS. 2 and 3, the fuel injectors 55 are shrouded at both sides by the induction system 46 and the exhaust system 62. Specifically, it is shrouded by the air inlet device 47 and the expansion chamber device 64 both of which are located in proximity to the fuel injectors 55.

At this point, it should be noted that the raised portion 18 of the hull is formed with an upwardly extending flange 62 which surrounds an access opening 63 that affords access to not only the fuel injectors 57 and spark plugs 58, but also other components of the engine for servicing. The seat 17 has a removable portion that overlies and closes this opening 63. However, it can be easily accessed for servicing by removing the seat portion 17 as should be readily apparent.

It should also be noted that the fuel injector 58 are positioned well above the waterline WL that exists when the watercraft is floating in a body of the water. Under planing conditions, this waterline falls even lower as indicated in FIG. 2 as WLp. Thus, the fuel injectors 57 will be well protected under all conditions.

From the expansion chamber device 64, the exhaust gases are passed rearwardly through an exhaust pipe 65 to a suitable discharge. A water trap device (not shown) may be provided in this discharge to protect the engine from water being drawn into the exhaust ports 59 through the exhaust system 62.

The fuel supply system for supplying fuel to the fuel injector 57 will now be described by primary reference to FIGS. 2 and 3 wherein it is shown in part schematically and certain of the components are shown in locations other than their actual physical location so as to permit understanding of the system.

Specifically, the fuel tank 24 supplies fuel through a conduit to a low-pressure pump 65. This low-pressure pump 65 may be driven by pulsations in the induction system or mechanically from a component of the engine. It, in turn, delivers fuel through a conduit 66 to a fuel filter 67 which is mounted either on the forward side of the bulkhead 32, as seen in FIG. 1; or at the rear of the engine in the void area 68*b* over the coupling 26 between the crankshaft 25 and the impeller shaft 28 or at a void area 68*a* at the front of the engine 21 over the flywheel cover 61, as shown in FIG. 2; or at a side of the raised area 18, as seen in FIG. 3. The fuel filter is mounted in either location by means of threaded fasteners 69.

Fuel flows from the fuel filter 67 to a high pressure pump 71 where it is delivered to a fuel rail 72 that extends along and is attached to the fuel injector 57 in a known manner. The high pressure pump 71 may be of any known type that will deliver fuel at the desired pressure.

A fuel pressure regulator 73 is positioned at the rearward end of the fuel manifold 72 and regulates the pressure of fuel delivered to the injector 57 by dumping excess fuel back to the fuel tank through a return line 74. Thus, it will be seen that not only are the fuel injectors 57 protected by the exhaust expansion chamber device 64 and the intake device 47, but so also are the fuel rails 72.

Because of the operation in the marine environment, a water sensor 74 may be provided in the fuel filter 67. This communicates with a control unit 75 so as to activate a warning 76 in the event water is present in the fuel to too great an extent.

Figure 4:
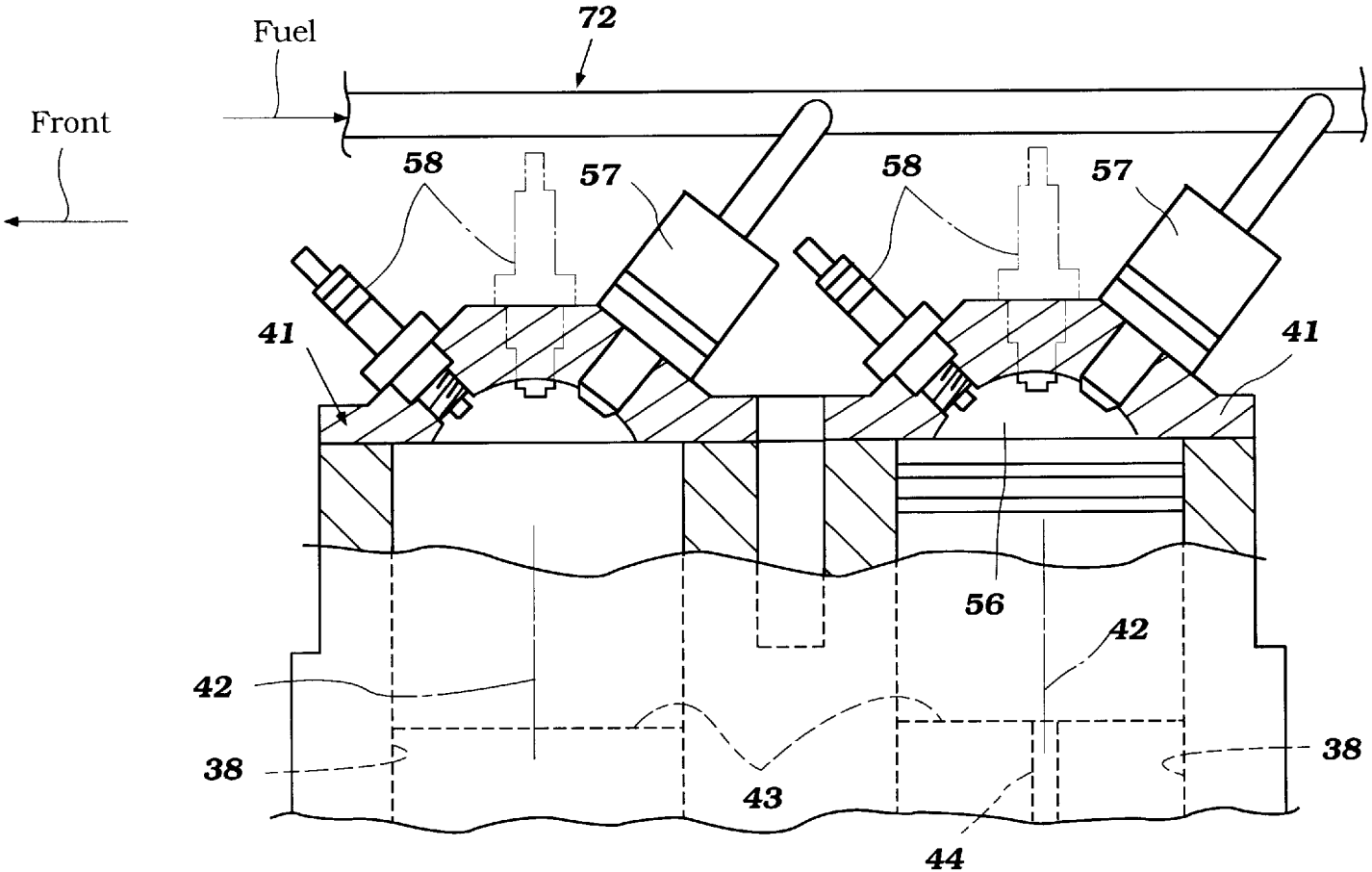
FIG. 4 is a partial side elevational view, in part similar to FIG. 2, and shows two other alternate embodiments of the invention.

In the embodiment as thus far described, the fuel injectors 57 have been disposed so as to spray along the bore axis 42 and the spark plugs 58 have been inclined forwardly toward the front of the engine while still being positioned in the plane that contains the cylinder bore axis 42. As seen in the solid line view of FIG. 4, it is possible to incline the fuel injector 57 in a rearward direction along the same plane as they lie in the embodiment of FIGS. 1–3. This will still place them in an arrangement where they will be protected by both the induction system 46 and the exhaust system 61. Alternatively with such an arrangement, the spark plugs 58 may be mounted vertically as shown in phantom lines in FIG. 4.

Instead of mounting the spark plugs 58 and fuel injector 57 so that they lie on the longitudinal plane that contains the cylinder bore axis 42 with one being spaced forwardly of the other, these components may be mounted in transverse, side by side relationship. The following embodiments shows such an arrangement.

Figure 5:
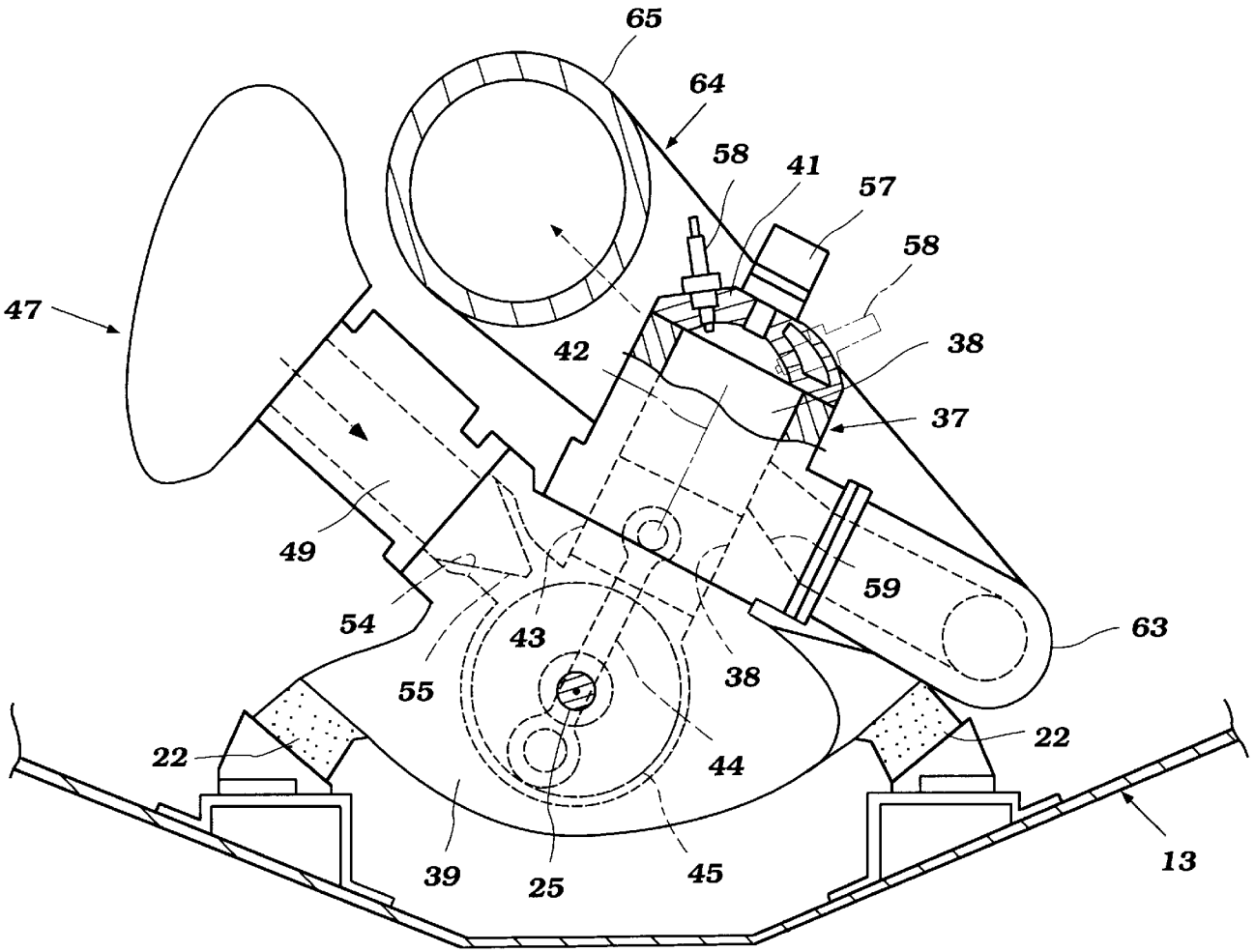
FIG. 5 is a partial cross-sectional view, in part similar to FIG. 3, and shows another embodiment of the invention.

Referring first to FIG. 5, this shows a slightly different manifold arrangement wherein the cylinder block 37 is positioned in the engine compartment so that it is inclined to one side of a vertically extending plane. With this arrangement, therefore, the induction system is moved downwardly and the expansion chamber device 64 is positioned on the same side of the engine. Thus, the expansion chamber device of the exhaust system and the air inlet device 47 are on the same side but again both are positioned vertically above the fuel injector 57 to protect them. The spark plug 58 may be mounted at one side or the other of the fuel injector 57 as shown in the solid and phantom line views of this Figure.

Figure 6:
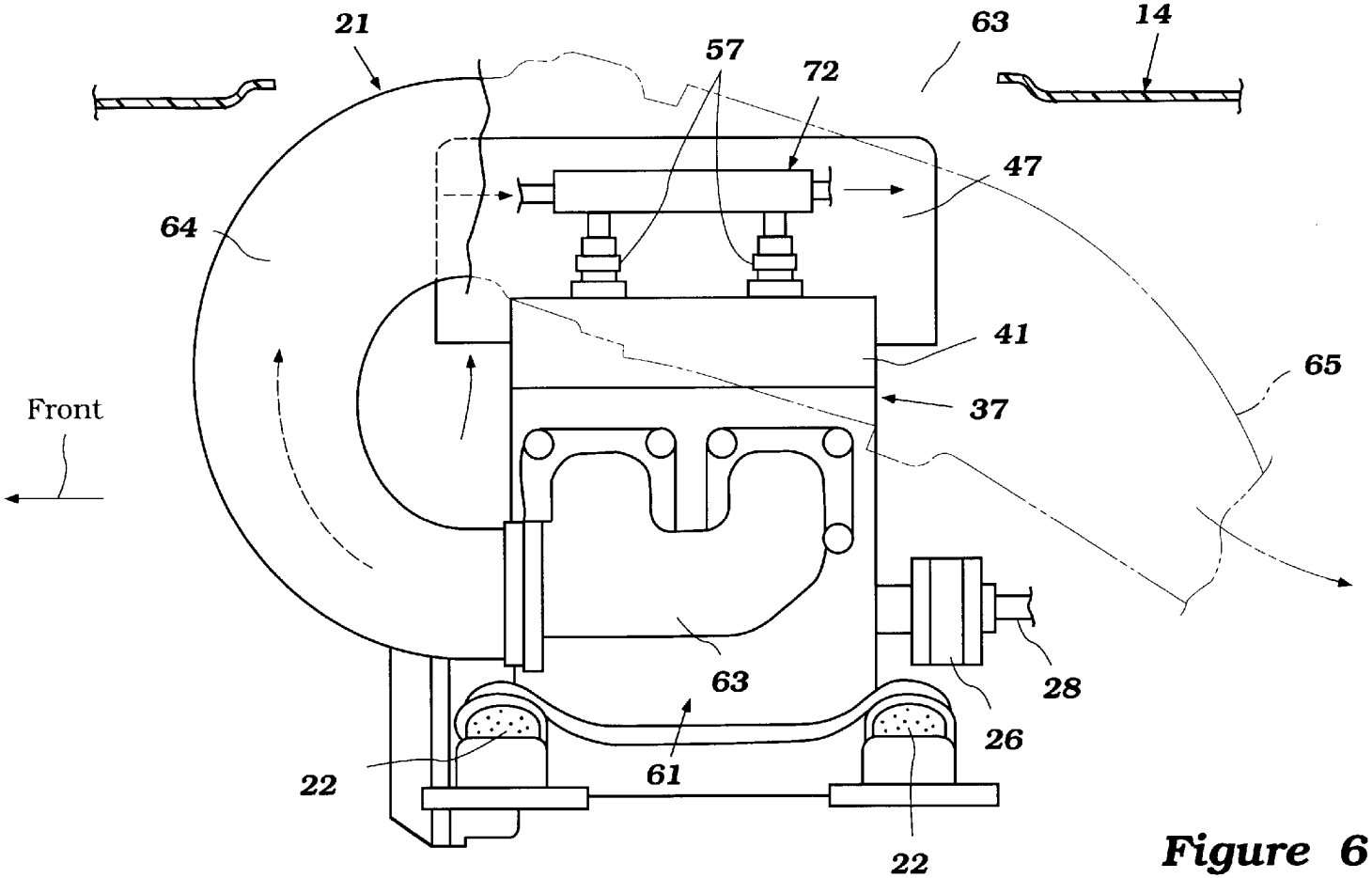
FIG. 6 is a partial side elevational view, in part similar to FIGS. 2 and 4, and shows yet another embodiment of the invention.
Figure 7:
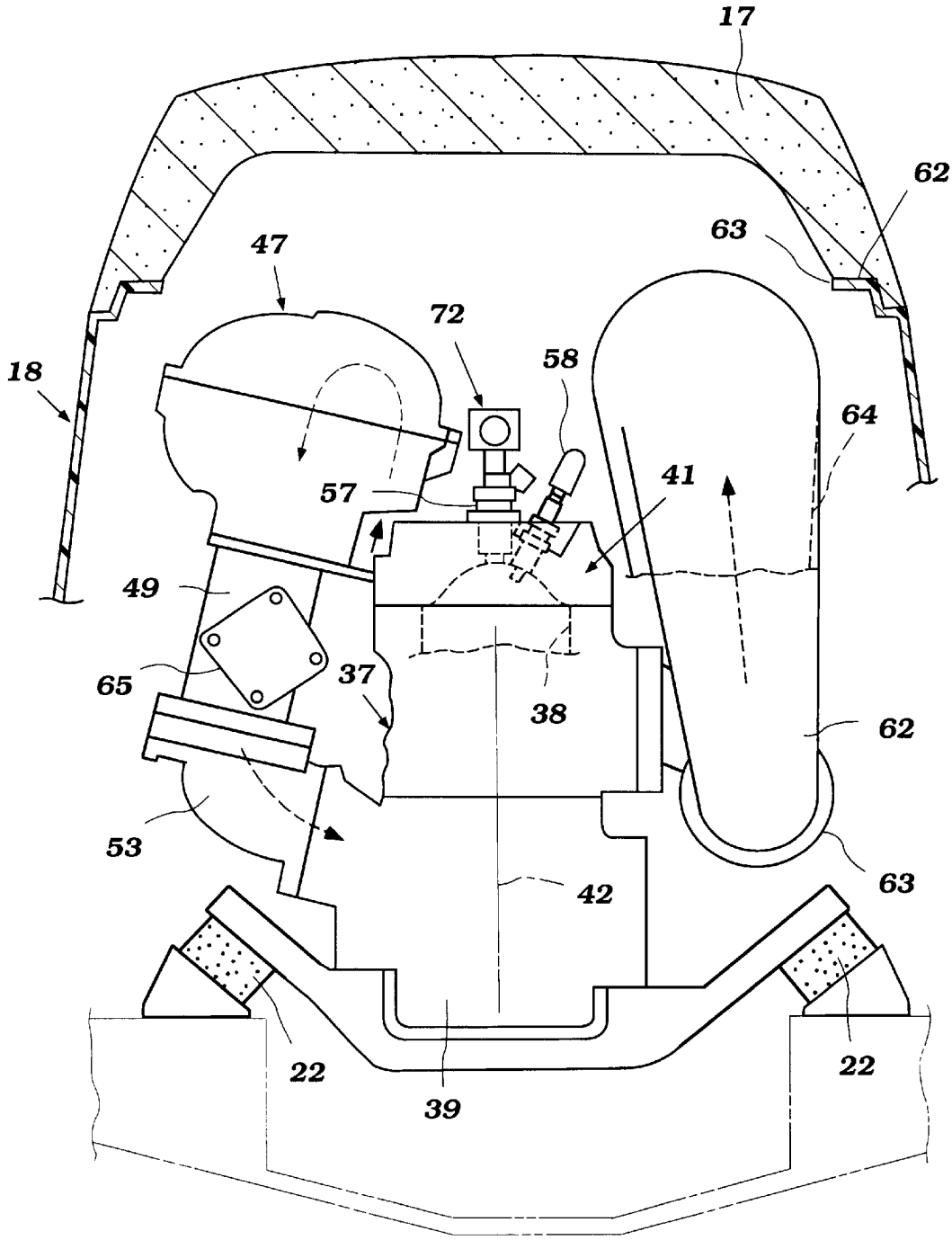
FIG. 7 is a cross-sectional, in part similar to FIG. 3 but shows the embodiment of FIG. 6.

FIGS. 6 and 7 show another embodiment where the injectors and the spark plugs are located in side by side relationship. In this embodiment, the over all engine is disposed like the embodiments of FIGS. 1–3 and 4 in that the cylinder bore axes 42 extend vertically and lie within the common longitudinal plane of the watercraft.

In FIGS. 6 and 7, the fuel injectors 57 are essentially vertically disposed. The spark plugs 58 are inclined toward one side, in this embodiment, the exhaust side.

Figure 8:
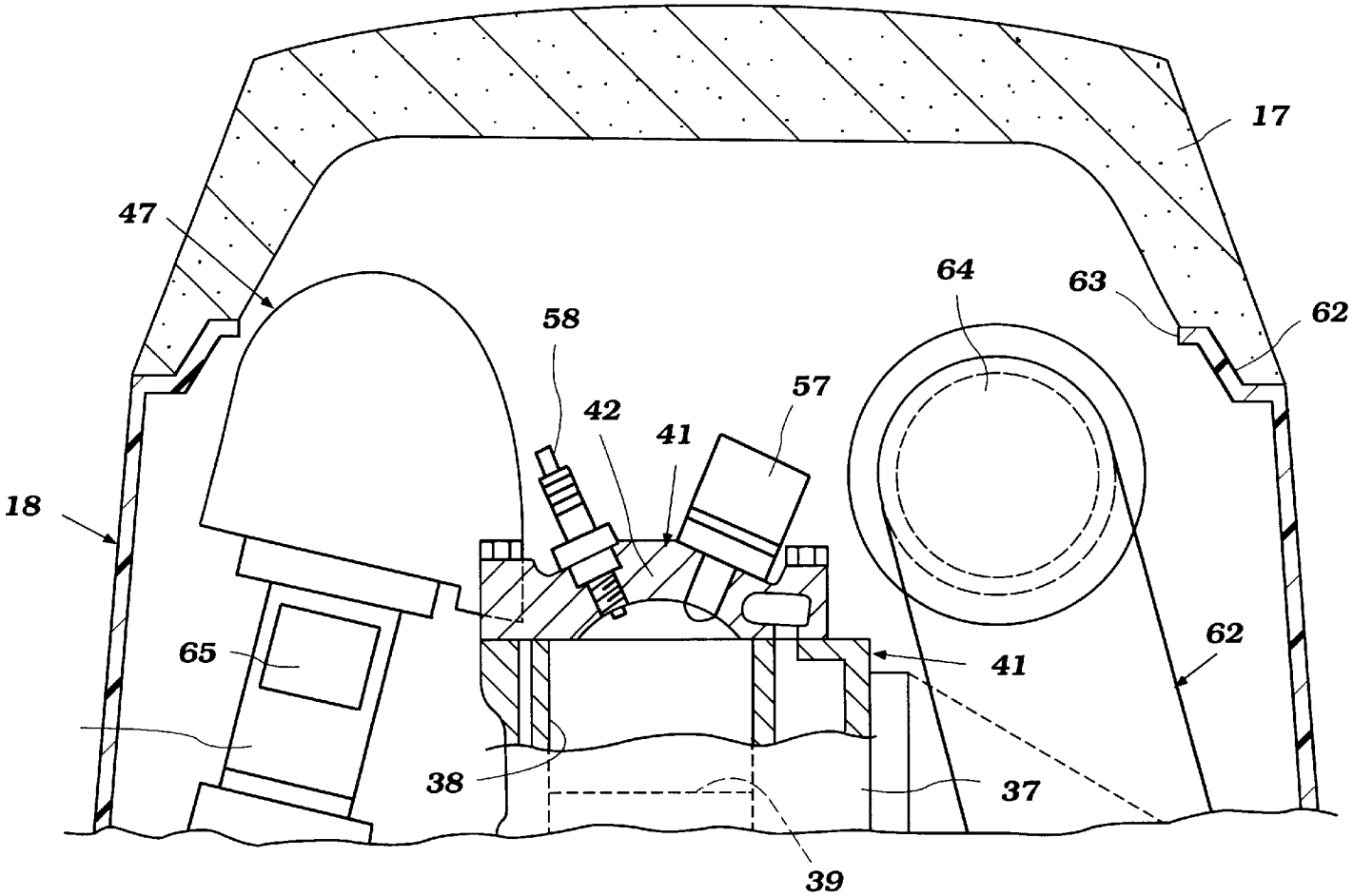
FIG. 8 is a cross-sectional, in part similar to FIGS. 3, 5 and 7 and shows a still further embodiment of the invention.

FIG. 8 shows a similar embodiment, but both the fuel injectors 57 and the spark plug 58 are inclined but in this case on opposite sides to the plane containing the cylinder bore axis 42.

Thus, from the foregoing description, it should be readily apparent that the described embodiments provide a direct injected personal watercraft engine and hull arrangement wherein the fuel injectors are positioned in location where they may be easily accessed but are protected from damage and from water. Of course, the foregoing description is that of preferred embodiments of the invention and various changes and modifications may be made without departing from the spirit and scope of the invention, as defined by the appended claims.

What is claimed is:

1. A personal watercraft comprised of a hull defining a rider's area for accommodating a rider and not more than three passengers, an engine compartment formed within said hull, an internal combustion engine having at least one cylinder bore vertically disposed and supported within said engine compartment and driving a hull watercraft propulsion device for propelling said hull through a body of water, a fuel injector supported in an upper portion of said engine for injecting fuel directly into a combustion chamber thereof formed at least in part by said cylinder bore, an air induction system for delivering an air charge to said combustion chamber, an exhaust system for discharging a burnt charge from said combustion chamber, at least a portion of one of said intake and said exhaust systems being positioned at a location vertically above and in proximity to said fuel injector for protecting said fuel injector while permitting access thereto for servicing.

2. A personal watercraft as set forth in claim 1, wherein there is further provided a spark plug for firing the charge in the combustion chamber.

3. A personal watercraft as set forth in claim 2, wherein the spark plug and the fuel injector have axes lying on a common transverse plane of the watercraft.

4. A personal watercraft as set forth in claim 1, wherein the engine operates on a two stroke crankcase compression principal, said engine including a crankcase chamber positioned beneath the combustion chamber thereof in which a crankshaft is rotatably journaled, the induction system delivering the air charge to the crankcase chamber, the exhaust system including an exhaust manifold affixed to a cylinder block formed between a cylinder head of the engine and the crankcase member for receiving the exhaust gases from the combustion chamber.

5. A personal watercraft as set forth in claim 4, wherein both of the intake and exhaust systems have portions that extend vertically above and in proximity to the fuel injector for protecting the fuel injector.

6. A personal watercraft as set forth in claim 5, wherein the portions of the intake and exhaust systems are disposed on opposite sides of the fuel injector transverse to a longitudinal axis of the hull.

7. A personal watercraft as set forth in claim 4, wherein the engine has a cylinder head and the fuel injector is mounted in the cylinder head.

8. A personal watercraft as set forth in claim 7, wherein both of the intake and exhaust systems have portions that extend vertically above and in proximity to the fuel injector for protecting the fuel injector.

9. A personal watercraft as set forth in claim 8, wherein the portions of the intake and exhaust systems are disposed on opposite sides of the fuel injector transverse to a longitudinal axis of the hull.

10. A personal watercraft as set forth in claim 4, wherein there is further provided a spark plug for firing the charge in the combustion chamber.

11. A personal watercraft as set forth in claim 10, wherein the spark plug and the fuel injector have axes lying on a common longitudinal plane of the watercraft.

12. A personal watercraft as set forth in claim 10, wherein the spark plug and the fuel injector have axes lying on a common transverse plane of the watercraft.

13. A personal watercraft as set forth in claim 1, wherein the rider's area includes a longitudinally extending vertically upwardly positioned seat on which the operator and passengers sit in straddled tandem fashion, the engine compartment being defined at least in part beneath said seat with the fuel injector being positioned beneath said seat.

14. A personal watercraft comprised of a hull defining a rider's area for accommodating a rider and not more than three passengers, an engine compartment formed within said hull, an internal combustion engine supported within said engine compartment and driving a hull watercraft propulsion device for propelling said hull through a body of water, a fuel injector supported in an upper portion of said engine for injecting fuel directly into a combustion chamber thereof, an air induction system for delivering an air charge to said combustion chamber, an exhaust system for discharging a burnt charge from said combustion chamber, both of said intake and exhaust systems having portions that extend vertically above and in proximity to said fuel injector for protecting said fuel injector.

15. A personal watercraft as set forth in claim 14, wherein the portions of the intake and exhaust systems are disposed on opposite sides of the fuel injector transverse to a longitudinal axis of the hull.

16. A personal watercraft comprised of a hull defining a rider's area for accommodating a rider and not more than three passengers, an engine compartment formed within said hull, an internal combustion engine supported within said engine compartment and driving a hull watercraft propulsion device for propelling said hull through a body of water, said engine having a cylinder block having at least one cylinder bore closed by a cylinder head and forming therewith a combustion chamber, an air induction system for delivering an air charge to said combustion chamber, an exhaust system for discharging a burnt charge from said combustion chamber, and a fuel injector mounted in said cylinder head for injecting fuel directly into said combustion chamber, at least a portion of one of said intake and said exhaust systems being positioned at a location vertically above and in proximity to said fuel injector for protecting said fuel injector while permitting access thereto for servicing.

17. A personal watercraft as set forth in claim 16, wherein both of the intake and exhaust systems have portions that extend vertically above and in proximity to the fuel injector for protecting the fuel injector.

18. A personal watercraft as set forth in claim 17, wherein the portions of the intake and exhaust systems are disposed on opposite sides of the fuel injector transverse to a longitudinal axis of the hull.

19. A personal watercraft comprised of a hull defining a rider's area for accommodating a rider and not more than three passengers, an engine compartment formed within said hull, an internal combustion engine supported within said engine compartment and driving a hull watercraft propulsion device for propelling said hull through a body of water, a fuel injector supported in an upper portion of said engine for injecting fuel directly into a combustion chamber thereof, an air induction system for delivering an air charge to said combustion chamber, a spark plug for firing the charge formed in said combustion chamber, an exhaust system for discharging a burnt charge from said combustion chamber, said spark plug and said fuel injector having axes lying on a common longitudinal plane of said watercraft, and at least a portion of one of said intake and said exhaust systems being positioned at a location vertically above and in proximity to said fuel injector for protecting said fuel injector while permitting access thereto for servicing.

* * * * *